US008026867B2

(12) United States Patent
Jung et al.

(10) Patent No.: US 8,026,867 B2
(45) Date of Patent: Sep. 27, 2011

(54) PLASMA DISPLAY DEVICE AND METHOD OF DRIVING THE SAME USING VARIABLE AND MULTI-SLOPE DRIVING WAVEFORMS

(75) Inventors: Yun Kwon Jung, Gumi-si (KR); Jong Sik Lim, Daegu (KR)

(73) Assignee: LG Electronics Inc., Seoul (KR)

( * ) Notice: Subject to any disclaimer, the term of this patent is extended or adjusted under 35 U.S.C. 154(b) by 1233 days.

(21) Appl. No.: 11/330,995

(22) Filed: Jan. 13, 2006

(65) Prior Publication Data

US 2006/0214885 A1 Sep. 28, 2006

(30) Foreign Application Priority Data

Mar. 22, 2005 (KR) ..... 10-2005-0023854

(51) Int. Cl.
*G09G 3/28* (2006.01)

(52) U.S. Cl. ..... 345/60

(58) Field of Classification Search ..... 345/60–71
See application file for complete search history.

(56) References Cited

U.S. PATENT DOCUMENTS

| | | | | |
|---|---|---|---|---|
| 6,459,212 | B2 * | 10/2002 | Tokunaga et al. | 315/169.4 |
| 6,483,250 | B1 * | 11/2002 | Hashimoto et al. | 315/169.4 |
| 6,756,950 | B1 | 6/2004 | Tsai et al. | 345/60 |
| 6,809,708 | B2 | 10/2004 | Kanazawa et al. | |
| 7,667,670 | B2 * | 2/2010 | Kitagawa et al. | 345/60 |
| 2001/0017605 | A1 | 8/2001 | Hashimoto et al. | 345/60 |
| 2001/0020923 | A1 * | 9/2001 | Homma | 345/60 |
| 2002/0054001 | A1 | 5/2002 | Awamoto | 345/60 |
| 2003/0090441 | A1 * | 5/2003 | Kim et al. | 345/60 |
| 2003/0107532 | A1 * | 6/2003 | Choi | 345/60 |
| 2003/0222835 | A1 * | 12/2003 | Yoon et al. | 345/60 |
| 2004/0246206 | A1 * | 12/2004 | Choi | 345/60 |
| 2005/0024296 | A1 * | 2/2005 | Nakamura et al. | 345/60 |
| 2005/0088375 | A1 | 4/2005 | Son | 345/60 |
| 2005/0116895 | A1 * | 6/2005 | Lee et al. | 345/60 |
| 2005/0243026 | A1 * | 11/2005 | Kim et al. | 345/60 |

FOREIGN PATENT DOCUMENTS

| | | |
|---|---|---|
| CN | 1419227 | 5/2003 |
| CN | 1539131 | 10/2008 |
| EP | 1 585 096 A2 | 10/2005 |

OTHER PUBLICATIONS

European Search Report dated Aug. 2, 2007.
Chinese Office Action dated Feb. 15, 2008.
Chinese Office Action dated Sep. 29, 2008.
Taiwanese Office Action dated Jul. 14, 2009.

* cited by examiner

*Primary Examiner* — Kevin Nguyen
*Assistant Examiner* — Liliana Cerullo
(74) *Attorney, Agent, or Firm* — KED & Associates LLP

(57) ABSTRACT

The present invention relates to a plasma display device and a method of driving the plasma display device. A gradually rising waveform and then a falling waveform are applied to the scan electrodes. A rising waveform has a slope different from that of a rising waveform applied in a first sub-field in at least one of sub-fields posterior to the first sub-field.

15 Claims, 11 Drawing Sheets

PLASMA DISPLAY DEVICE AND METHOD OF DRIVING THE SAME USING VARIABLE AND MULTI-SLOPE DRIVING WAVEFORMS

BACKGROUND OF THE INVENTION

This Nonprovisional application claims priority under 35 U.S.C. §119 a on Patent Application No. 10-2005-0023854 filed in Korea on Mar. 22, 2005, the entire contents of which are hereby incorporated by reference.

FIELD OF THE INVENTION

The present invention relates to a display device and method thereof, and more particularly a plasma display device and a method of driving the plasma display device.

2. Background of the Related Art

In general, a plasma display device displays pictures by exciting a phosphor using an ultraviolet ray that is generated when an inert mixture gas, such as He+Xe, Ne+Xe, or He+Xe+Ne, produces a discharge. Such a plasma display device can be thin and large with improved picture quality.

Such a plasma display device is time-divisionally driven with a frame being divided into a plurality of sub-fields, each sub-field having different light emissions so as to implement the gray scale of pictures. Each of the sub-fields is divided into a reset period for initializing a full screen, an address period for selecting a scan line and selecting a discharge cell from discharge cells on the selected scan line, and a sustain period for implementing gray scale according to the number of discharges.

For example, in the case of representing a picture with 256 gray scale, a frame period of 16.67 ms corresponding to 1/60 second is divided into eight sub-fields SF1 to SF8, as illustrated in FIG. 1. Each of the eight sub-fields SF1 to SF8 is divided into a reset period, an address period and a sustain period. Reset periods and address periods are the same for respective sub-fields, whereas a sustain period and the number of sustain pulses assigned to the sustain period increase by a rate of $2^n$ (n=0, 1, 2, 3, 4, 5, 6, 7).

The plasma display panel (PDP) represents gray scale using such sustain discharges. Accordingly, luminance can be increased and the capability to represent gray scale can be improved, in proportion to the sustain period. However, each of the sub-fields used to time-divisionally drive a single frame preferably requires a reset period for initializing cells and an address period for selecting discharge cells in addition to a sustain period for representing gray scale, which takes considerable time.

Further, with the increase of resolution, the total number of scan lines increases, so that the time required for address increases. Accordingly, in a conventional PDP having high resolution, a dual scan scheme is generally employed to compensate for the shortage of address time. However, the dual scan scheme requires two data drive units, so that the scheme accordingly has the disadvantage of incurring high production cost. As a result, measures for reducing periods other than a sustain period must be provided.

The above description is incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

Accordingly, an object of the present invention is to solve at least the problems and disadvantages of the background art.

An object of the present invention is to reduce the time of a prescribed period of a sub-field.

Another object of the present invention is to increase a resolution of a display device, preferably a PDP.

Another object of the present invention is to improve a dual scan.

Another object of the present invention is to allow use of single scan.

An object of the present invention is to provide a plasma display device and a method of driving the plasma display device, which are capable of acquiring a sufficient sustain period by reducing the time required for reset discharges.

The present invention can be achieved in a whole or in parts by a plasma display device and a driving method characterized by, when driving a PDP having scan electrodes and sustain electrodes with a frame divided into a plurality of sub-fields, including a reset period for initializing discharge cells by applying a gradually rising waveform and then a falling waveform to the scan electrodes, and applying a rising waveform, which has a slope different from that of a rising waveform applied in a first sub-field, in at least one of sub-fields posterior to the first sub-field.

The present invention can be achieved in a whole or in parts by a plasma display device and driving method characterized by, when driving a PDP having scan electrodes and sustain electrodes with a frame divided into a plurality of sub-fields, including a reset period for initializing discharge cells by applying a gradually rising waveform and, successively, a falling waveform to the scan electrodes, applying a positive polarity waveform to the sustain electrodes and a negative polarity waveform to the scan electrodes, in a pre-reset period anterior to the reset period, and applying a rising waveform, which has a slope different from that of a rising waveform applied in a first sub-field, in at least one of sub-fields posterior to the first sub-field.

The present invention can be achieved in a whole or in parts by a plasma display device and driving method characterized by, when driving a PDP having scan electrodes and sustain electrodes with a frame divided into a plurality of sub-fields, including a reset period for initializing discharge cells by applying a gradually rising waveform and, successively, a falling waveform to the scan electrodes, applying a ground potential or 0V to the sustain electrodes in the reset period and a positive polarity bias voltage in a time point at which the address period successive to the reset period starts, and applying a rising waveform, which has a slope different from that of a rising waveform applied in a first sub-field, in at least one of sub-fields posterior to the first sub-field.

The present invention preferably increases a sustain period by reducing a reset period required for the initialization of discharge cells. Accordingly, the present invention has the advantages of increasing luminance by sufficient sustain discharges and improving the capability to represent gray scale.

Furthermore, the present invention preferably operates a plasma display device having high resolution using a single scan manner instead of a dual scan manner, so that the size of a driving circuit can be reduced, thus reducing manufacturing cost.

The device and method are preferably characterized in that the first drive unit applies a rising waveform having a slope larger than a slope of the rising waveform applied in the first sub-field, in at least one of sub-fields posterior to the first sub-field.

The device and method are preferably characterized in that the first drive unit applies a rising waveform having a slope one or three times the slope of the rising waveform applied in the first sub-field, in at least one of sub-fields posterior to the first sub-field.

The device and method are preferably characterized in that the first drive unit applies a first rising waveform having a first slope to the scan electrodes and, successively, a second rising waveform having a second slope to the scan electrodes, in the first sub-field; and the first drive unit applies a third rising waveform having a third slope to the scan electrodes and, successively, a fourth rising waveform having a fourth slope to the scan electrodes, in at least one of sub-fields posterior to the first sub-field.

The device and method are preferably characterized in that the second rising waveform and the fourth rising waveform rise to a first voltage.

The device and method are preferably characterized in that the second rising waveform rises to a second voltage, and the fourth rising waveform rises to the second voltage or a third voltage lower than the second voltage.

The device and method are preferably characterized in that the third voltage is lower than the second voltage by more than 10V and less than 100V.

The device and method are preferably characterized in that the first slope of the first rising waveform is equal to or larger than the second slope of the second rising waveform.

The device and method are preferably characterized in that the third slope of the third rising waveform is equal to or larger than the fourth slope of the fourth rising waveform.

The device and method are preferably characterized in that the third slope of the third rising waveform is equal to or larger than the first slope of the first rising waveform.

The device and method are preferably characterized in that the fourth slope of the fourth rising waveform is equal to or larger than the second slope of the second rising waveform.

The device and method are preferably characterized in that the fourth slope of the fourth rising waveform is more than one time larger than and less than three times larger than the second slope of the second rising waveform.

The device and method are preferably characterized by applying a positive polarity waveform to the sustain electrodes and a negative polarity waveform to the scan electrodes, in a pre-reset period anterior to the reset period.

The device and method are preferably characterized in that the second drive unit applies a positive polarity waveform to the sustain electrodes and a negative polarity waveform to the scan electrodes, in at least a pre-reset period of the first sub-field in each frame.

The device and method are preferably characterized in that the positive polarity waveform applied to the sustain electrodes is any one of a gradually rising waveform and a positive polarity square wave.

The device and method are preferably characterized in that the negative polarity waveform applied to the scan electrodes is any one of a gradually falling waveform and a positive polarity square wave.

The device and method are preferably characterized in that the gradually falling negative polarity waveform has a slope equal to a slope of the falling waveform applied in a setdown period of the reset period.

The device and method are preferably characterized in that the positive polarity waveform has a voltage value larger than a voltage value of a positive polarity bias voltage applied to the sustain electrodes in the address period.

The device and method are preferably characterized in that the positive polarity waveform has a voltage value equal to a voltage value of a negative polarity scan pulse applied to the scan electrodes in the address period.

The device and method are preferably characterized by applying a ground potential or 0V to the sustain electrodes in the reset period and a positive polarity bias voltage in a time point at which the address period successive to the reset period starts.

The present invention can be achieved in a whole or in parts by a plasma display device comprising: a PDP having scan electrodes and sustain electrodes; a first drive unit for initializing discharge cells by applying a gradually rising waveform and, successively, a falling waveform to the scan electrodes in a reset period; and a second drive unit for applying a ground potential or 0V to the sustain electrodes in the reset period and a positive polarity bias voltage in a time point at which the address period successive to the reset period starts, wherein the first drive unit applies a rising waveform, which has a slope different from that of a rising waveform applied in a first sub-field, in at least one of sub-fields posterior to the first sub-field. The first drive unit applies a rising waveform having a slope larger than a slope of the rising waveform applied in the first sub-field, in at least one of sub-fields posterior to the first sub-field. The first drive unit applies a rising waveform having a slope one or three times the slope of the rising waveform applied in the first sub-field, in at least one of sub-fields posterior to the first sub-field.

The present invention can be achieved in a whole or in parts by a first drive unit applying a first rising waveform having a first slope to the scan electrodes and, successively, a second rising waveform having a second slope to the scan electrodes, in the first sub-field; and the first drive unit applying a third rising waveform having a third slope to the scan electrodes and, successively, a fourth rising waveform having a fourth slope to the scan electrodes, in at least one of sub-fields posterior to the first sub-field. The second rising waveform and the fourth rising waveform rise to a first voltage. The second rising waveform rises to a second voltage, and the fourth rising waveform rises to the second voltage or a third voltage lower than the second voltage. The third voltage is lower than the second voltage by more than 10V and less than 100V.

The first slope of the first rising waveform is preferably equal to or larger than the second slope of the second rising waveform.

The third slope of the third rising waveform is preferably equal to or larger than the fourth slope of the fourth rising waveform.

The third slope of the third rising waveform is preferably equal to or larger than the first slope of the first rising waveform.

The fourth slope of the fourth rising waveform is preferably equal to or larger than the second slope of the second rising waveform. The fourth slope of the fourth rising waveform is preferably more than one time larger than and less than three times larger than the second slope of the second rising waveform.

The present invention preferably includes a second drive unit for applying a positive polarity waveform to the sustain electrodes and a negative polarity waveform to the scan electrodes, in a pre-reset period anterior to the reset period. The second drive unit preferably applies a positive polarity waveform to the sustain electrodes and a negative polarity waveform to the scan electrodes, in at least a pre-reset period of the first sub-field in each frame. The positive polarity waveform applied to the sustain electrodes is preferably any one of a gradually rising waveform and a positive polarity square wave.

The negative polarity waveform applied to the scan electrodes is preferably any one of a gradually falling waveform and a positive polarity square wave. The gradually falling negative polarity waveform preferably has a slope equal to a slope of the falling waveform applied in a setdown period of the reset period.

The positive polarity waveform preferably has a voltage value larger than a voltage value of a positive polarity bias voltage applied to the sustain electrodes in the address period.

The positive polarity waveform preferably has a voltage value equal to a voltage value of a negative polarity scan pulse applied to the scan electrodes in the address period.

The present invention preferably includes a third drive unit for applying a ground potential or 0V to the sustain electrodes in the reset period and a positive polarity bias voltage in a time point at which the address period successive to the reset period starts.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Embodiments of the present invention are described in detail with reference to the accompanying drawings.

Figure 1:
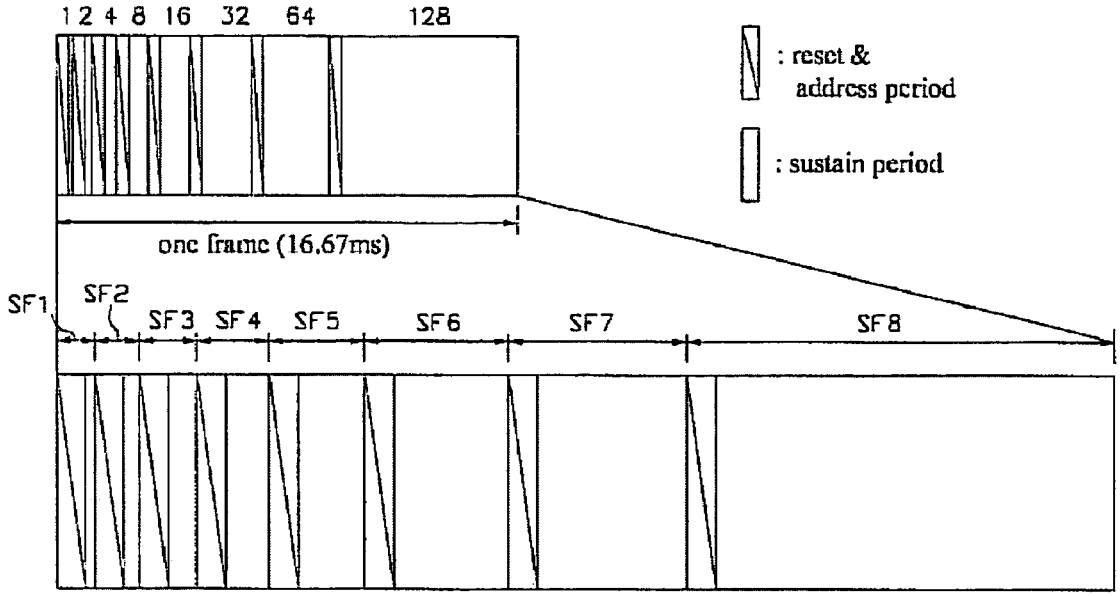
FIG. 1 is a diagram illustrating the sub-field pattern of an 8-bit default code for implementing 256 gray scale in a plasma display device.
Figure 2:
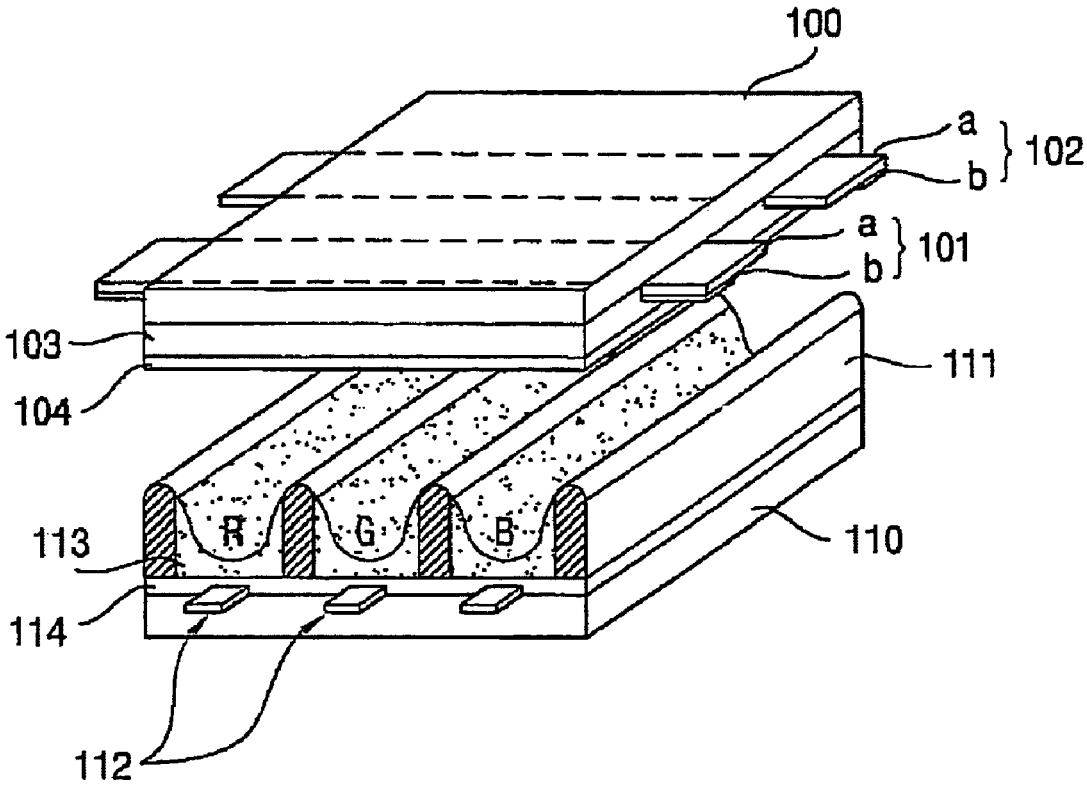
FIG. 2 illustrates a structure of a plasma display panel (PDP).

FIG. 2 is a structural diagram showing a plasma display panel in accordance with an embodiment of the present invention. An upper substrate 100 serves as a display plane on which image is to be displayed and a lower substrate 110 serves as a back plane. The upper substrate 100 and the lower substrate are combined in parallel at a predetermined distance.

The upper substrate 100 includes paired scan electrodes 101 and sustain electrodes 102, i.e., paired scan electrodes 101 and sustain electrodes 102, having transparent electrodes 101*a* and 102*a* made of transparent (indium tin oxide) ITO material and bus electrodes 101*b* and 102*b* made of a metal material, for causing a discharge in a cell and maintaining the discharge in the cell. The scan electrodes 101 and the sustain electrodes 102 are covered with a dielectric layer 103 for limiting discharge currents and for insulating the electrode pairs, and a protection layer 104 of Magnesium Oxide (MgO) for facilitating discharge conditions on the dielectric layer 103. As can be appreciated, one insulating material may be used instead of the dielectric layer and a protection layer.

The lower substrate 110 includes barrier ribs 111 of stripe type (or well type) arranged in parallel for generating a plurality of discharge spaces, i.e. discharge cells. Further, a plurality of address electrodes 112 are arranged in parallel with the barrier ribs 111. The lower substrate 110 is spread with R, G, B fluorescent substance that emits visible rays for displaying image upon a discharge in the cell. A dielectric 114 is provided between the address electrodes 112 and the fluorescent substance 113 for protecting the address electrodes 112 and reflecting visible rays emitted from the fluorescent substance to the upper substrate 100. An inert mixture gas, such as He+Xe, Ne+Xe, He+Xe+Ne, is introduced into a discharge space between the upper substrate and lower substrate. In alternative embodiments, the barrier ribs can be also formed in the direction of the scan/sustain electrodes in addition to the barrier ribs in the direction of the address electrodes. The plasma display panel may have R, G, B cells formed in a delta configuration rather than in a row of R, G, B cells.

Figure 3:
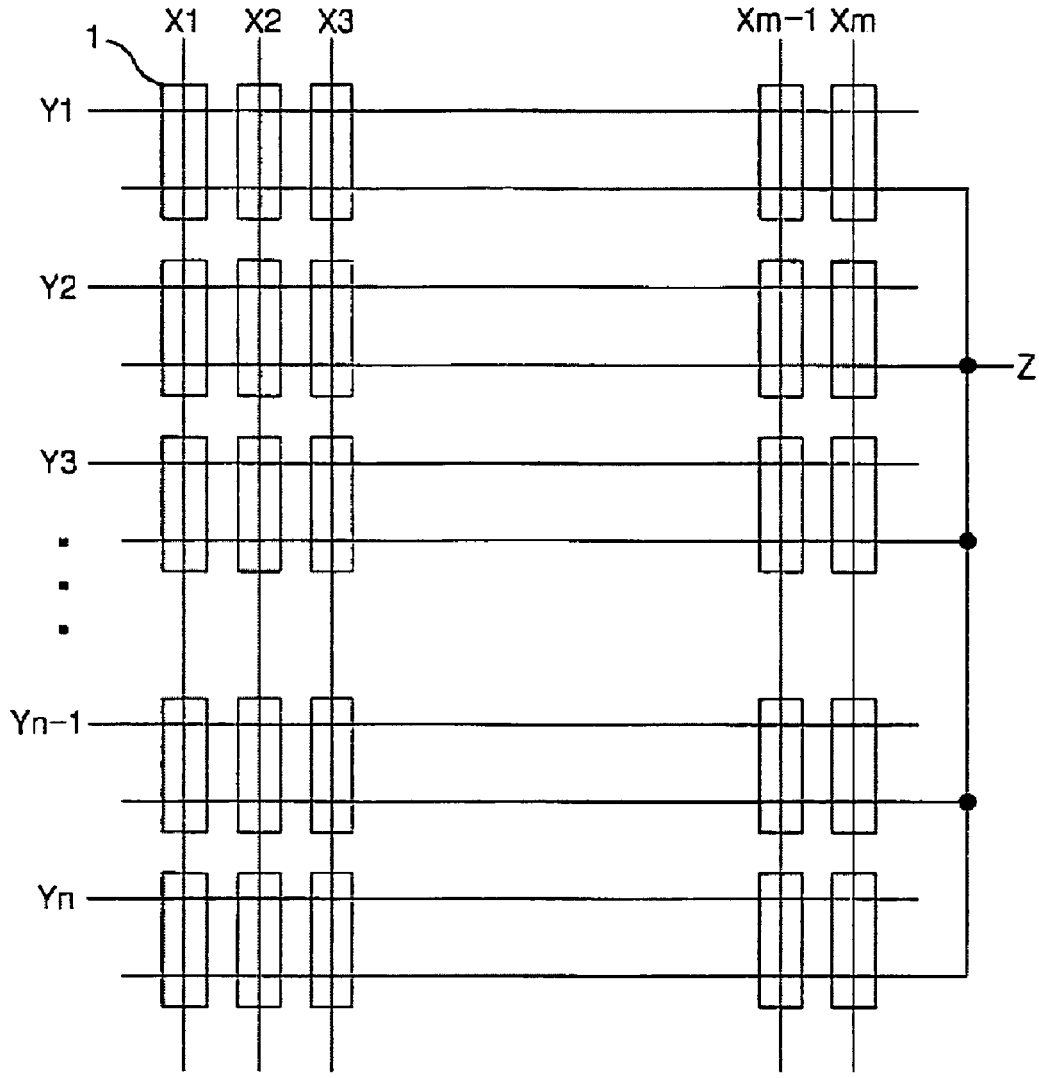
FIG. 3 is a plan view schematically illustrating the arrangement of the electrodes of a three-electrode AC surface discharge PDP.

FIG. 3 schematically illustrates the arrangement of the electrodes of a three-electrode Alternating Current (AC) surface discharge Plasma Display Panel (PDP) illustrated in FIG. 2. The three-electrode AC surface discharge PDP includes scan electrodes Y1 to Yn and sustain electrodes Z formed on an upper substrate and address electrodes X1 to Xm formed on a lower substrate and arranged to intersect the scan electrodes Y1 to Yn and the sustain electrodes Z at right angles. Discharge cells 1 are arranged in matrix form at the intersections between the scan electrodes Y1 to Yn, the sustain electrodes Z and the address electrodes X1 to Xm to each represent one of red, green and blue.

Figure 4:
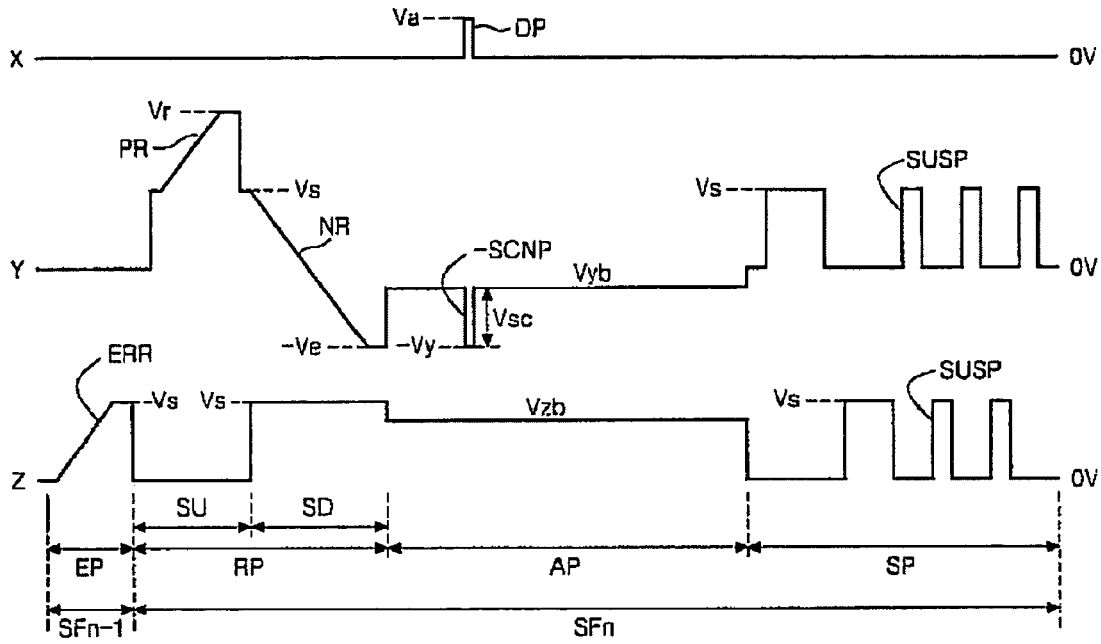
FIG. 4 is a waveform diagram illustrating the drive waveforms for a PDP.

FIG. 4 is a diagram illustrating drive waveforms applied to the PDP of FIGS. 2 and 3, and FIGS. 5*a* to 5*e* are diagrams illustrating the distribution of wall charges in a discharge cell, which vary according to the drive waveforms of FIG. 4. The analysis of the waveform and the distribution of wall charges illustrate the discovered problems of such wave forms, and ways of solving such problems.

Referring to FIG. 4, each sub-field SFn−1 and SFn includes a reset period RP for initializing the discharge cells 1 of a full screen, an address period AP for selecting a discharge cell, a sustain period SP for sustaining the discharge of the selected discharge cell 1, and an erase period EP for erasing wall charges in the discharge cell 1.

An erase ramp waveform ERR is applied to the sustain electrodes Z in the erase period EP of an (n−1)th sub-field SFn−1. A voltage of 0V is applied to the scan electrodes Y and the address electrodes X in the erase period EP. The erase ramp waveform ERR is a positive ramp waveform in which voltage gradually increases from 0V to positive polarity sustain voltage Vs. Erase discharges are generated between scan electrodes Y and sustain electrodes Z in ON-cells where sustain discharges are generated by the erase ramp waveform ERR. The wall charges in the ON-cells are erased by the erase discharges. As a result, each discharge cell 1 has the distribution of wall charges shown in FIG. 5*a*, immediately after the erase period EP.

In the setup period SU of the reset period RP in which a nth sub-field SFn starts, a positive ramp waveform PR is applied to all the scan electrode Y and a voltage of 0V is applied to the sustain electrodes Z and the address electrodes X. Due to the positive ramp waveform PR in the setup period UP, the voltage on the scan electrodes Y gradually increases from positive polarity sustain voltage Vs to reset voltage Vr higher than the positive polarity sustain voltage Vs. Due to the positive ramp waveform PR, dark discharges (or weak discharges), in which light is rarely generated, occur between the scan electrodes Y and the address electrodes X in the discharge cell of the full screen, and simultaneously, dark discharges occur between the scan electrodes Y and the sustain electrodes Z.

Figure 5A:
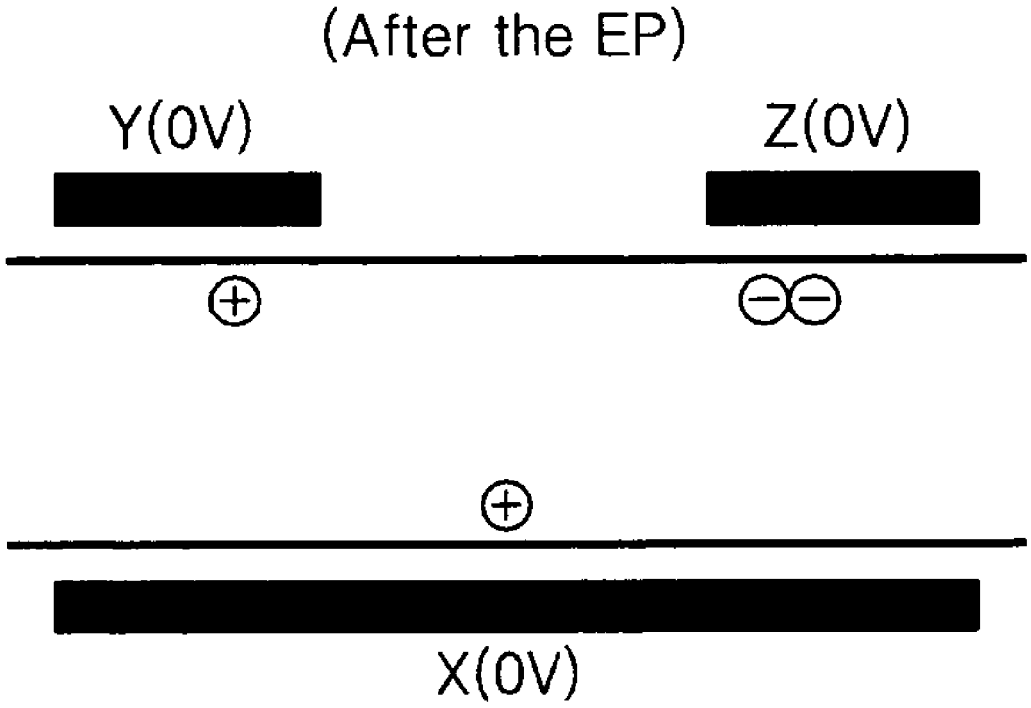
FIGS. 5*a* to 5*e* are diagrams illustrating the distribution of wall charges in a discharge cell, which vary according to the drive waveforms of FIG. 4.
Figure 5B:
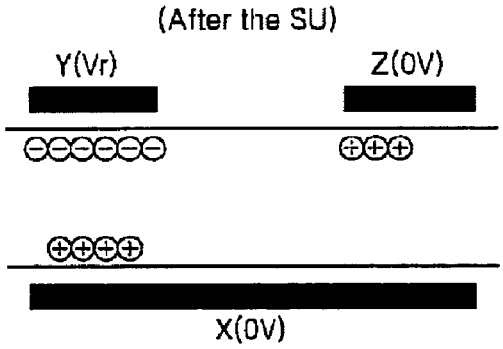

As a result of the dark discharges, immediately after the setup period SU, positive polarity wall charges remain on the address electrodes X and the sustain electrodes Z, and negative polarity wall charges remain on the scan electrodes Y, as shown in FIG. 5*b*. While the dark discharges occur in the setup period SU, the gap voltage Vg (or voltage difference) between the scan electrodes Y and the sustain electrodes Z and the gap voltage between the scan electrodes Y and the address electrodes X are initialized to a voltage close to a firing voltage Vf, which can generate a discharge.

After the setup period SU, a negative ramp waveform Nr is applied to the scan electrodes Y in the setdown period SD of the reset period RP. Simultaneously, positive polarity sustain voltage Vs is applied to the sustain electrode Z and a voltage of 0V is applied to the address electrodes X. Due to the negative ramp waveform NR, a voltage on the scan electrodes Y gradually decreases from a positive polarity sustain voltage Vs to a negative polarity erase voltage Ve. Due to the negative ramp waveform NR, in the discharge cells of the full screen, dark discharges occur between the scan electrodes Y and the address electrodes X, and almost simultaneously, dark discharges occur between the scan electrodes Y and the sustain electrodes Z.

Figure 5C:
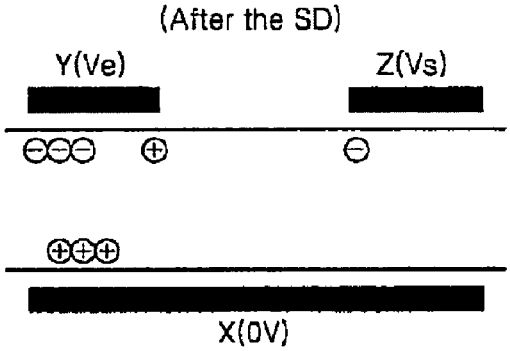

As a result of the dark discharges in the setdown period SD, the distribution of wall charges in each discharge cell 1 varies to the state in which address is possible, as shown in FIG. 5*c*. At this time, on the scan electrodes Y and the address electrodes X in the respective discharge cells 1, excessive wall charges unnecessary for address discharges are erased and predetermined numbers of wall charges remain. As negative polarity wall charges moving from the scan electrodes Y are accumulated, the polarity of wall charges on the sustain electrodes Z is inverted from positive polarity to negative polarity. While dark discharges occur in the setdown period SD of the reset period RP, the gap voltage or voltage difference between the scan electrodes Y and the sustain electrodes Z and the gap voltage between the scan electrodes Y and the address electrodes X approach the firing voltage Vf.

In the address period AP, a negative polarity scan pulse −SCNP is sequentially applied to the scan electrodes Y, and a positive polarity data pulse DP is applied to the address electrodes X in synchronization with the scan pulse −SCNP. The voltage of the scan pulse −SCNP is a scan voltage Vsc that decreases from 0V or a negative polarity scan bias voltage Vyb to a negative polarity scan voltage −Vy. The voltage of the data pulse DP is a positive polarity data voltage Va. In the address period AP, a positive polarity Z bias voltage Vzb lower than the positive polarity sustain voltage Vs is supplied to the sustain electrodes Z. In the state in which the gap voltage has been adjusted to a voltage close to the firing voltage Vf immediately after the reset period RP, as the gap voltage between the scan electrodes Y and the address electrodes X exceeds the firing voltage Vf, primary address discharges are generated between the electrodes Y and X in the ON-cells to which the scan voltage Vsc and the data voltage Va are applied.

Figure 5D:
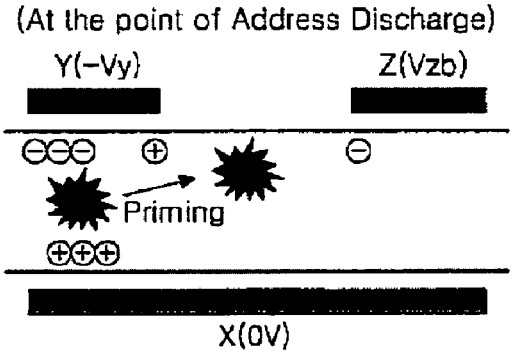
Figure 5E:
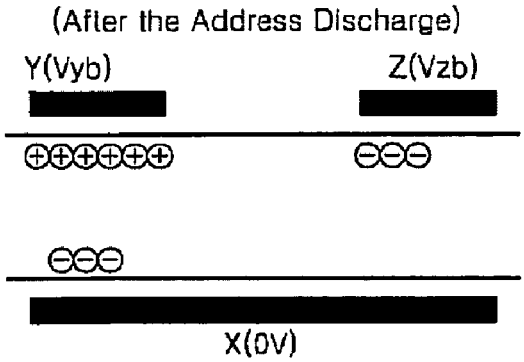

At this time, the primary address discharges between the scan electrodes Y and the address electrodes X are generated in regions adjacent to edges remote from the gaps between the scan electrodes Y and the sustain electrodes Z. The primary discharges between the scan electrodes Y and the address electrodes X generate priming charged particles in the discharge cells and, thus, induce secondary discharges between the scan electrodes Y and the sustain electrodes Z, as shown in FIG. 5*d*. The distribution of wall charges in the ON-cells in which the address discharges were generated is as shown in FIG. 5*e*. Meanwhile, the distribution of wall charges in the OFF-cells in which address discharges were not generated is maintained substantially as shown in FIG. 5*c*.

In the sustain period SP, the sustain pulses SUSP having the positive polarity sustain voltage Vs are alternately applied to the scan electrodes Y and the sustain electrodes Z. In the ON-cells selected by the address discharges, the sustain discharges are generated between the scan electrodes Y and the sustain electrodes Z in every sustain pulse SUSP with the assistance of the distribution of wall charges shown in FIG. 5*e*.

In contrast, in OFF-cells with the distribution of wall charges in the OFF-cells of FIG. 5*c*, no discharges are generated in the sustain period, because the gap voltage between the scan electrodes Y and the sustain electrodes Z does not exceed the firing voltage Vf when the first positive polarity sustain voltage Vs is applied to the scan electrodes Y.

Figure 6:
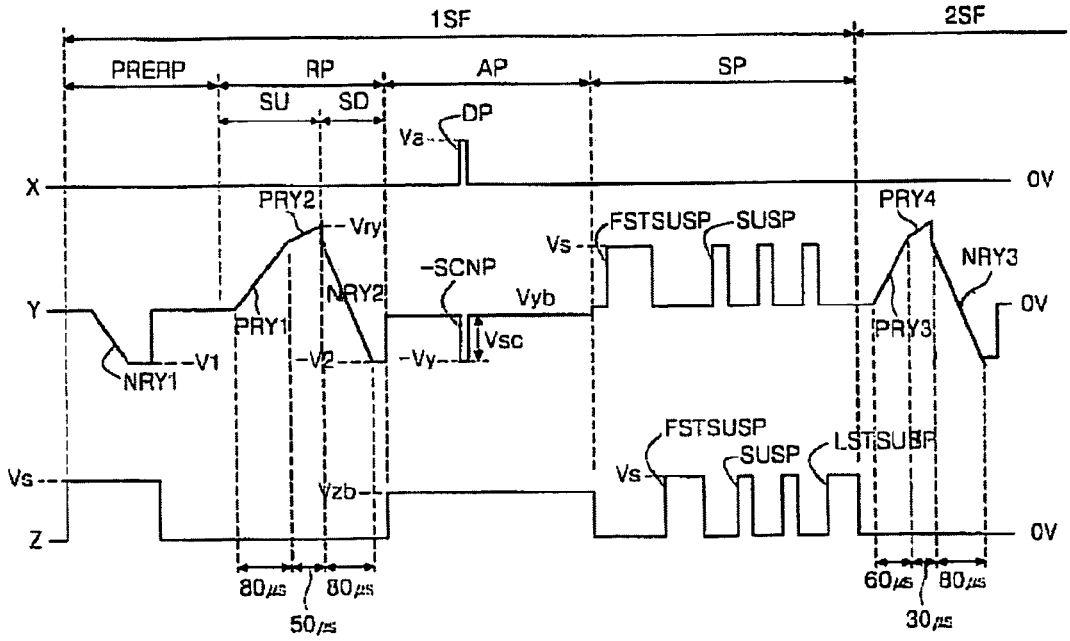
FIG. 6 is a diagram illustrating a method of driving a PDP according to an embodiment of the present invention.

FIG. 6 is a diagram illustrating a method of driving a plasma display device in accordance with a first embodiment of the present invention, and FIG. 7*a* to FIG. 7*f* are diagrams illustrating the distribution of wall charges in a discharge cell, which varies according to drive waveforms shown in FIG. 5. As shown, a first sub-field includes a pre-reset period PRERP for forming positive polarity wall charges on scan electrodes Y and negative polarity wall charges on sustain electrodes Z, a reset period RP for initializing the discharge cells of the screen, preferably, full screen, using the distribution of wall charges formed in the reset period PRERP, an address period AP for selecting discharge cells, and a sustain period SP for sustaining discharges in the selected discharge cells.

Figure 7A:
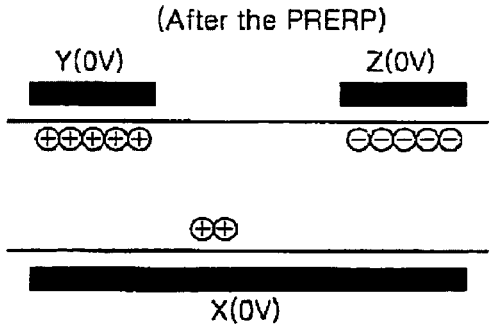
FIG. 7*a* to FIG. 7*f* are diagrams illustrating the distribution of wall charges in a discharge cell, which vary according to the drive waveforms of FIG. 6.

In the pre-reset period PRERP, a square wave having a positive polarity voltage Vs is preferably applied to sustain electrodes Z, a first falling ramp waveform NRY1 that falls from 0V or a ground voltage GND to a negative polarity voltage −V1 is preferably applied to the scan electrodes Y, and a voltage of 0V is preferably applied to the address electrodes X. The square wave having a positive polarity voltage Vs and the first falling ramp waveform NRY1 generate dark discharges between the scan electrodes Y and the sustain electrodes Z and between the sustain electrodes Z and the address electrodes X preferably in all discharge cells. As a result of the discharge, immediately after the pre-reset period PRERP and in the all discharge cells, a number of positive polarity wall charges are accumulated on the scan electrodes Y and a number of negative polarity wall charges are accumulated on the sustain electrode, as shown in FIG. 7*a*. Furthermore, positive polarity wall charges are accumulated on the address electrodes X. Due to the distribution of wall charges shown in FIG. 7*a*, sufficiently large positive gap voltages or voltage differences are preferably formed between the scan electrodes Y and the sustain electrodes Z in the internal discharge spaces of all the discharge cells and electrical fields extend from the scan electrodes Y toward the sustain electrodes Z in respective discharge cells.

The first falling ramp waveform NRY1 applied to the scan electrodes Y in the pre-reset period PRERP may be applied in the form of a negative polarity square wave. In contrast, the positive polarity square wave applied to the sustain electrodes Z may be applied in the form of a rising waveform whose voltage value gradually increases. In another embodiment, in the pre-reset period PRERP, a wall voltage may be generated by applying a voltage to only one of a scan electrode Y and a sustain electrode Z. Such variations are appreciated by one of ordinary skill in the art depending on the construction of a drive circuit for applying voltages to the scan electrodes Y and the sustain electrodes Z and the control sequence of a control device.

In the setup period SU of the reset period RP, a first Y positive ramp waveform PRY1 and then a second Y positive ramp waveform PRY2 are successively applied to every scan electrode Y, and a voltage of 0V is applied to the sustain electrodes Z and the address electrodes X. The voltage of the first Y positive ramp waveform PRY1 increases from 0V to the positive polarity sustain voltage Vs, and the voltage of the second Y positive ramp waveform PRY2 increases from the positive polarity sustain voltage Vs to a positive polarity Y reset voltage Vry higher than the positive polarity sustain voltage Vs. The slope of the second Y positive ramp waveform PRY2 is less than that of the first Y positive ramp waveform PRY1. Furthermore, the slopes of the first Y positive ramp waveform PRY1 and the second Y positive ramp waveform PRY2 may be set equal to each other.

Under the wall voltage condition formed in the pre-reset period PRERP, the first Y positive ramp waveform PRY1 is applied to the scan electrodes Y and the voltage between the scan electrodes Y and the sustain electrodes Z reaches a surface discharge firing voltage, a surface discharge occurs between each pair of sustain electrodes. When the voltage between the scan electrodes Y and the address electrodes X reaches a firing voltage due to a ramp waveform rising to Vry, opposite discharge is generated between the scan electrodes Y and the address electrodes X. The surface discharge and the opposite discharge are discharges that are generated by ramp waveforms, and may be generated in dark discharge form.

Figure 7B:
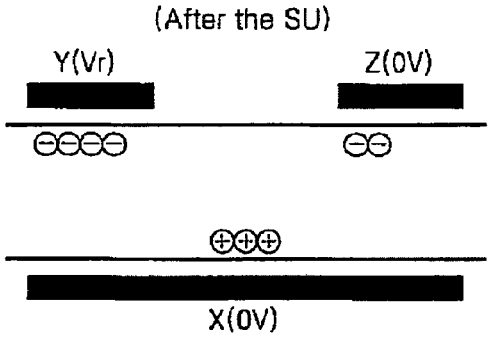

As a result of the discharges, as negative polarity wall charges are accumulated on the scan electrodes Y in all the discharge cells immediately after the setup period SU, as shown in FIG. 7*b*, the polarity of the wall charges is changed from positive polarity to negative polarity, and positive polarity wall charges are further accumulated on the address electrodes X. Furthermore, as the number of negative polarity wall charges on the scan electrodes Y decreases, the number of wall charges accumulated on the sustain electrodes Z somewhat decreases, but the polarity thereof is maintained at negative polarity.

Meanwhile, before the dark discharge is generated in the setdown period SU based on the distribution of wall charges formed immediately after the pre-reset period PRERP, the positive gap voltage in all the discharge cells is sufficiently high, and the Y reset voltage Vr may be lower than a reset voltage Vr shown in FIG. 4.

As a result of a test in which the distributions of wall charges in all the discharge cells were initialized immediately before the setup discharge, as shown in FIG. 7*a*, it was discovered that the setup discharge was generated in all the discharge cells at a voltage lower than the sustain voltage Vs, that is, in the interval of the first Y positive ramp waveform PRY1, in weak discharge form. Accordingly, the second Y positive ramp waveform PRY2 may not be necessary for the drive forms of FIG. 6.

Although a voltage applied to the scan electrodes Y in the voltage setup period SU can stably generate setup discharge even in the case where the voltage increases to the sustain voltage Vs due to the first Y positive ramp waveform PRY1, a second positive ramp waveform PRY2 is applied so as to stably generate setup discharge and prevent erroneous discharge. Since positive polarity wall charges are sufficiently accumulated on the address electrodes X during the reset period PRERP and the setup period SU, the absolute values of externally applied voltages necessary for address discharge, e.g., a data voltage and a scan voltage, can be reduced.

After the setup period SU, and in the setdown period SD, a second Y negative ramp waveform NRY2 is applied to the scan electrodes Y. The voltage of the second Y negative ramp waveform NRY2 decreases from the positive polarity sustain voltage Vs to the negative polarity −V2 voltage. The negative polarity −V2 voltage may be set equal to or different from −V1 voltage of the pre-reset period PRERP. When wall charges are appropriately accumulated in the charge cells in the setup period and erroneous discharge, such as a brilliant spot, does not occur, the −V2 voltage and the −V1 voltage are set equal to each other, thus allowing a single voltage to be applied in the pre-reset period and the setdown period. When wall charges are insufficiently accumulated in the discharge cells in the setup period, the absolute voltage of −V2 is set to a voltage higher than the absolute voltage of −V1 so that the generation of erroneous discharge can be prevented by sufficiently erasing wall charges when the wall charges are excessively accumulated.

At this time, the sustain electrodes Z are maintained at 0V or ground potential, as in the setup period SU. Accordingly, opposite discharges are generated between the scan electrodes Y and the address electrodes X in the setdown period SD. Due to such opposite discharges, positive polarity wall charges are accumulated on the portion of the address electrodes X adjacent to the scan electrodes Y. As positive polarity wall charges are accumulated on the portion of the address electrodes X adjacent to the scan electrodes Y, discharge delay is reduced at the time of an address discharge in the subsequent address period, thus improving jitter characteristics.

In the reset period RP, the rising ramp waveforms PRY1 and PRY2 and the falling ramp waveform NRY2 applied in the setup period SU and the setdown period SD, respectively are applied over a sufficiently long time so as to prevent erroneous discharges. The ramp waveforms are applied while forming gradual slopes. For example, the first positive ramp waveform PRY2 is applied for 70~150 μs, the second positive ramp waveform PRY2 is applied for 40~100 μs, and the second falling ramp waveform NRY2 is applied for 70~150 μs. The time intervals indicated in FIG. 6 are exemplary.

Meanwhile, a positive polarity Z bias voltage Vzb lower than the positive polarity sustain voltage Vs is applied to the sustain electrodes Z, which maintains a 0V or a ground potential in the reset period, just before and just after the address period or during the address period. Accordingly, in the address period subsequent to the reset period, address discharges between the scan electrodes Y and the address electrodes X are activated.

In the address period AP, the negative polarity scan pulse −SCNP is sequentially applied to the scan electrode Y and, simultaneously, the positive polarity data pulse DP is applied to the address electrodes X in synchronization with the scan pulse −SCNP. The voltage of the scan pulse −SCNP is a scan voltage Vsc that decreases from 0V or the negative polarity scan bias voltage Vyb close to 0V to the negative polarity scan voltage −Vy. The voltage of the data pulse DP is a positive polarity data voltage Va.

In the address period AP, the positive polarity Z bias voltage Vzb lower than the positive polarity sustain voltage Vs is supplied to the sustain electrodes Z. As the gap voltage or voltage difference between the scan electrodes Y and the address electrodes X exceeds the firing voltage Vf in ON-cells, to which the scan voltage Vsc and the data voltage Va are applied, while the gap voltage for all the discharge cells remains adjusted to an optimal address condition immediately after the reset period RP, opposite discharges are generated between the scan electrodes Y and the address electrodes X.

Figure 7C:
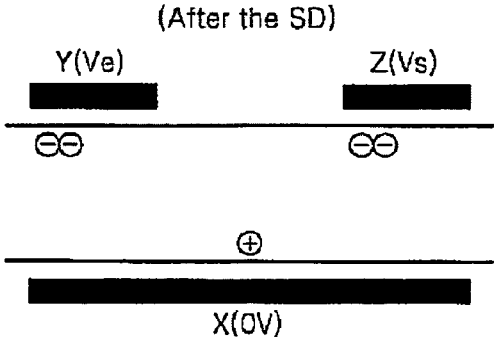
Figure 7D:
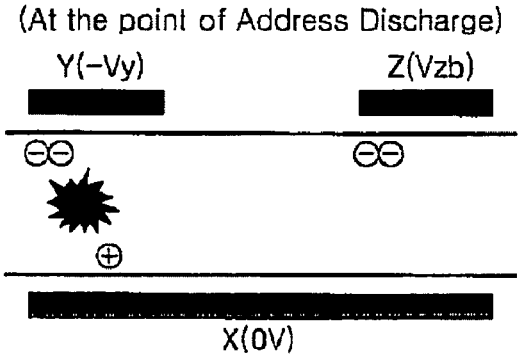
Figure 7E:
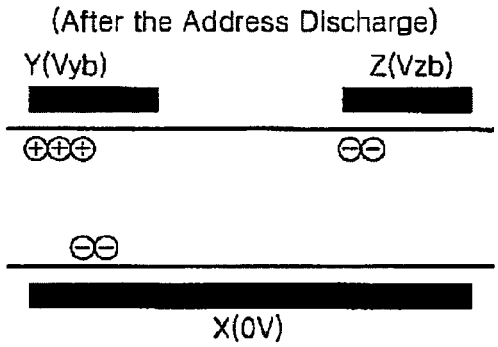

The distribution of wall charges in ON-cells, which allows address discharges to be generated, is as shown in FIG. 7*d*. Immediately after the address discharge, the distribution of wall charges in the ON-cells is changed as shown in FIG. 7*e* as, due to the address discharges, positive polarity wall charges are accumulated on the scan electrodes Y and negative polarity wall charges are accumulated on the address electrodes X. Meanwhile, in OFF-cells where address discharges are not generated, the distribution of wall charges is substantially maintained as shown in FIG. 7*c*.

In the sustain period SP, the sustain pulses FIRSTSUSP, SUSP and LSTSUSP of a positive polarity sustain voltage Vs are alternately applied to the scan electrodes Y and the sustain electrodes Z. In the sustain period SP, a voltage of 0V or a ground voltage is supplied to the address electrodes X. The width of the sustain pulse FSTSUSP that is applied to the scan electrodes Y and the sustain electrodes Z first is set to a width larger than that of a normal sustain pulse SUSP so as to stabilize the initiation of sustain discharges. Furthermore, a last sustain pulse LSTSUSP is applied to the sustain electrodes Z, where the width of the last sustain pulse LSTSUSP is set to a width larger than that of a normal sustain pulse SUSP so that negative polarity wall charges can be sufficiently accumulated on the sustain electrodes Z in the early stage of the setup period SU.

Since ON-cells selected by the address discharges form wall charges as shown in FIG. 7*e*, sustain discharges are generated between the scan electrodes Y and the sustain electrodes Z for each sustain pulse SUSP in the sustain period. In contrast, since OFF-cells have the distribution of wall charges of FIG. 7*c* in the initial stage of the sustain period SP, the gap voltage is maintained below the firing voltage Vf even if the sustain pulses FIRSTSUSP, SUSP and LSTSUSP are applied, so that discharges are not generated.

A sub-field posterior to or after the first sub-field starts with a reset period in which a rising ramp waveform and a falling ramp waveform are applied to the scan electrodes Y with a pre-reset period PRERP being preferably omitted or alternatively included. A reset period RP posterior to the second sub-field includes a setup period, in which positive ramp waveforms PRY3 and PRY4 having different slopes are successively applied to the scan electrodes Y, and a setdown period in which a third falling ramp waveform NRY3 is applied to the scan electrodes Y, like the first sub-field.

At that time, in the reset period RP posterior to the second sub-field, the discharge cells have been sufficiently primed by the discharges in the first sub-field, a margin is not considerably influenced even though the slopes of the third and fourth positive ramp waveforms PRY3 and PRY4 may be respectively set to the slopes of the first and second positive ramp waveforms PRY1 and PRY2 that were applied in the reset period of the first sub-field. Therefore, the slopes of the third and fourth positive ramp waveforms PRY3 and PRY4 applied in the setup period SU can be respectively set to the slopes of the first and second positive ramp waveforms PRY1 and PRY2 applied in the first sub-field.

Alternatively, the slope of the fourth positive ramp waveform PRY4 is preferably set to a slope larger than or equal to the slope of the second positive ramp waveform PRY2 applied in the first sub-field. The discharge cells in which address discharges were not generated in the first sub-field and, thus, sustain discharges were not generated are initialized to the state in which address discharges are easily generated, as shown in FIG. 7*c*, in the initial stage of the second sub-field.

Figure 7F:
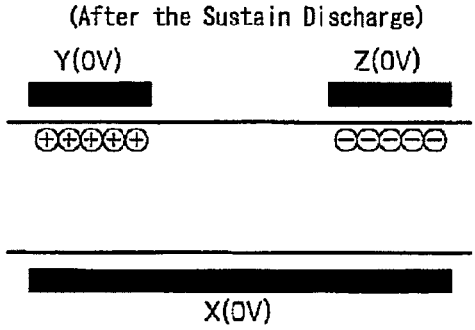

Furthermore, in the discharge cells in which the sustain discharges were generated in the first sub-field, as a sustain pulse LASTSUS having a width larger than that of the normal sustain pulse SUSP is supplied, a large number of positive polarity wall charges are formed on a scan electrode Y and a large number of negative polarity wall charges are formed on a sustain electrode Z, as shown in FIG. 7*f*. Accordingly, the wall charges are formed such that discharges for initialization can be easily generated in the reset period of the next sub-field, so that the periods of the application of rising waveforms supplied in the setup period of the second sub-field posterior to the first sub-field can be reduced. In other words, the setup period of the second sub-field, third and fourth positive ramp waveforms PRY3 and PRY4 having large slopes are preferably applied in this embodiment.

In other words, the slope of the third positive ramp waveform PRY3 may be set to a slope one to three times the slope of the first positive ramp waveform PRY1 applied in the reset period of the first sub-field. Furthermore, the slope of the fourth positive ramp waveform PRY4 may be set to a slope one to three times the slope of the second positive ramp waveform PRY2 applied in the reset period of the first sub-field. Meanwhile, when the slopes of the third and fourth positive ramp waveforms PRY3 and PRY4 are respectively more than three times the slopes of the first and second positive ramp waveforms PRY1 and PRY2, a margin cannot acquired in the reset period and contrast is degraded due to the occurrence of strong discharges in the reset period.

As a result, since the slopes of the third and fourth positive ramp waveforms PRY3 and PRY4 are respectively larger than the slopes of the first and second positive ramp waveforms PRY1 and PRY2, the reset period included in the sub-field posterior to the first sub-field is reduced. Accordingly, even in a high-definition PDP, a sufficient address period can be acquired by reducing the reset period, so that the PDP can be operated at high speed in a single scan drive manner. Here, the single scan drive refers to a method of scanning all the scan electrodes formed over the entire screen of the PDP at one time or sequentially using a single data drive unit, instead of separately scanning two groups of scan electrodes, which are respectively formed in the two divided screen regions of the PDP, using two data drive units.

For example, the third positive ramp waveform PRY3 is applied for 50~100 μs, and the fourth positive ramp waveform PRY4 is applied for 20~60 μs. The time periods or intervals illustrated in FIG. 6 are exemplary. The following sets forth 4 different ways to reduce the set up SU period:

(1) slope of PRY3=slope of PRY1 and slope of PRY4>slope of PRY2; or (2) slope of PRY3>slope of PRY1 and slope of PRY4>slope of PRY2; or (3) slope of PRY3>slope of PRY1 and slope of PRY4=slope of PRY2.

(4) slope of PRY3>slope of PRY1 and slope of PRY4<slope of PRY2 if the peak voltage of PRY4 is less than the voltage Vry of PRY2 or if the time period for PRY4 is less than the time period for PRY2.

By reducing the time for which the rising ramp waveform is applied in the reset period, a sufficient address period can be acquired and a longer sustain period can be acquired. For example, in the case where the time for which the rising ramp waveform is applied in the reset period for a single sub-field by about 40 μs, a total of 360 μs can be reduced in a PDP that operates with a single frame being divided into 10 sub-fields. Accordingly, corresponding time can be assigned to sustain periods, so that luminance can be improved and the capability to represent gray scale can be improved, thus improving picture quality.

Figure 8:
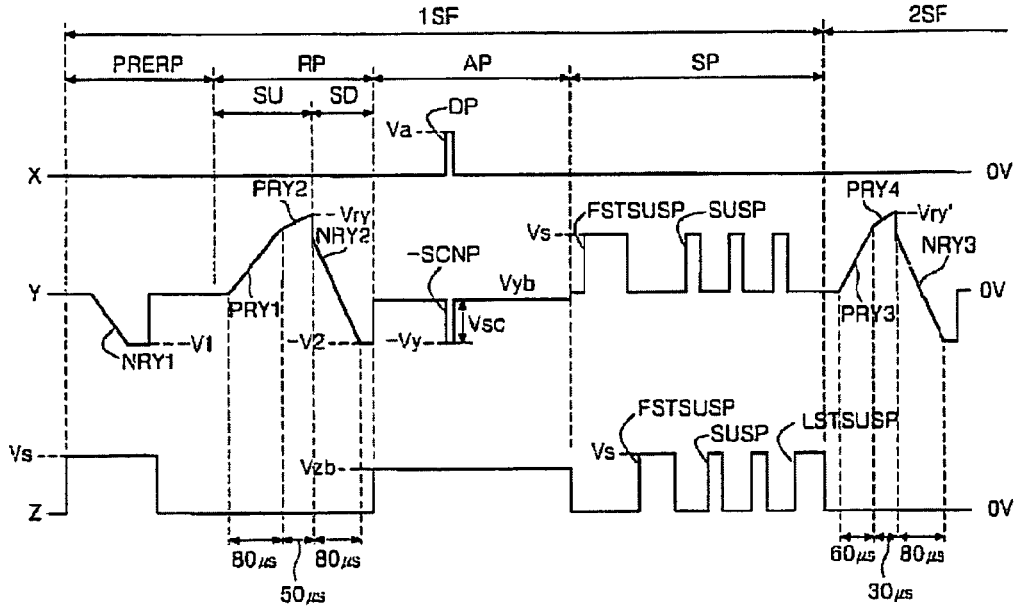
FIG. 8 is a diagram illustrating a method of driving a PDP according to another embodiment of the present invention.

FIG. 8 is a diagram illustrating a method of driving a plasma display device in accordance with another embodiment of the present invention. Similar to the previous embodiment, no erase discharge is generated between the sustain period SP and the reset period RP, and a setdown discharge and an address discharge are generated using positive polarity wall charges, which are accumulated on the address electrode by a sustain discharge in a previous sub-field, for each sub-field. The setdown discharges and address discharges are generated between the scan electrodes Y and the address electrodes X by maintaining the voltage of the sustain electrodes Z at 0V or a ground voltage GND in the setdown period SD and using wall charges accumulated on the address electrodes X in a previous sub-field.

Prior to the setup period SD, sufficient wall charges can be accumulated in the respective discharge cells. For this reason, the method of driving a plasma display device in accordance with the second embodiment of the present invention can reduce a reset voltage Vry' in sub-fields SF2~SFn other than an initial sub-field SF1. In the sub-fields SF2~SFn other than the initial sub-field SF1, the reset voltage Vry' lower than a reset voltage Vry in the initial sub-field SF1 by 15~25[V] can be applied.

In the sub-fields SF2~SFn other than the initial sub-field SF1, setup discharges can be generated in all discharge cells using only a sustain voltage Vs without increasing the voltage to the reset voltage Vry. As a result of the application of the drive waveforms of FIG. 8 to the PDP, it was ascertained that the delay value of the address discharge, that is, a jitter value, was considerably reduced in proportion to the sequential position of sub-fields.

Figure 9:
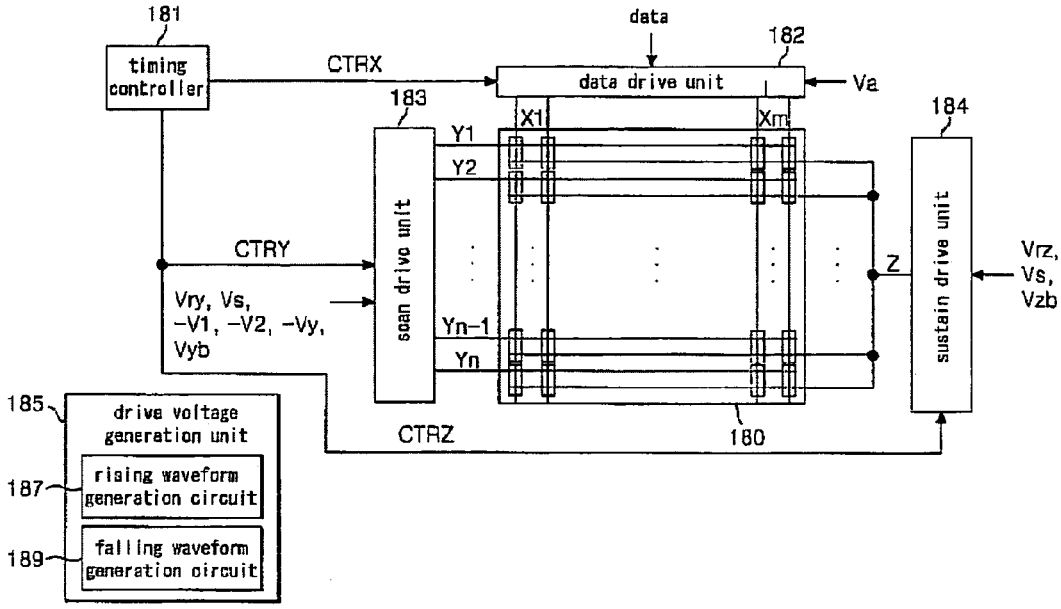
FIG. 9 is a schematic diagram illustrating a plasma display device according to an embodiment of the present invention.

FIG. 9 is a schematic diagram illustrating a plasma display device according to an embodiment of the present invention. The plasma display device includes a PDP 180, a data drive unit 182 for providing data to the address electrodes X1 to Xm of the PDP 180, a scan drive unit 183 for driving the scan electrodes Y1 to Yn of the PDP 180, a sustain drive unit 184 for driving the sustain electrodes Z of the PDP 180, a timing controller 181 for controlling the drive units 182, 183 and 184, and a drive voltage generation unit 185 for generating drive voltages necessary for the drive units 182, 183, and 184. Preferably, the driver 185 is provided in the drivers 182, 183 and 184.

Data that have been inverse-gamma-corrected and error-diffused through an inverse gamma correction circuit (not shown) and an error diffusion circuit (not shown) and then mapped to preset sub-field pattern through a sub-field mapping circuit are provided to the data drive unit 182. The data drive unit 182 applies 0V or a ground voltage to the address electrodes X1 to Xm in the pre-reset period PRERP, the reset period RP and the sustain period SP, as shown in FIG. 6. The data drive unit 182 may supply a positive polarity bias voltage, for example, a data voltage Va, which is supplied from the drive voltage generation unit 185, to the address electrodes X1 to Xm in the setdown period SD of the reset period RP. Furthermore, the data drive unit 182 samples and latches data and then supplies the data to the address electrodes X1 to Xm in the address period AP, under the control of the timing controller 181.

The scan drive unit 183, under the control of the timing controller 181, supplies the ramp waveforms NRY1, PRY1, PRY2, and NRY2 to the scan electrodes Y1 to Yn so as to initialize all the discharge cells in the pre-reset period PRERP and the reset period RP as shown in FIG. 6 and sequentially supplies the scan pulse SCNP to the scan electrodes Y1 to Yn so as to select scan lines, to which data are provided, in the address period AP. The scan drive unit 183 supplies the sustain pulses FSTSUSP and SUSP to the scan electrodes Y1 to Yn in the sustain period SP so as to allow sustain discharges to be generated in selected ON-cells.

The sustain drive unit 184, under the control of the timing controller 181, supplies the ramp waveforms PRZ, NRZ1, and NRZ2 to the sustain electrodes Z in the pre-reset period PRERP and the reset period RP so as to initialize all the discharge cells as illustrated in FIG. 6, and supplies the Z bias voltage Vzb to the sustain electrodes Z in the address period AP. Furthermore, the sustain drive unit 184 and the scan drive unit 183 supply the sustain pulses FSTSUSP, SUSP and LSTSUSP to the sustain electrodes Z in the sustain period SP while alternating in operation.

The timing controller 181 controls the drive unit 182, 183 and 184 in such a way as to receive horizontal/vertical synchronization signals and a clock signal, generate timing control signals CTRX, CTRY and CTRZ necessary for the drive units 182, 183 and 184 and supply the timing control signals CTRX, CTRY and CTRZ to corresponding drive units 182, 183 and 184. The timing control signal CTRX includes a sampling signal for sampling data supplied to the data drive unit 182, a latch control signal, and switch control signals for controlling the on/off times of an energy recovery circuit and a drive switch element. The timing control signal CTRY applied to the scan drive unit 183 includes switch control signals for controlling the on/off times of an energy recovery circuit and a drive switch element contained in the scan drive unit 183. Furthermore, the timing control signal CTRZ applied to the sustain drive unit 184 includes a switch control signal for controlling the on/off times of an energy recovery and a drive switch element contained in the sustain drive unit 184.

The drive voltage generation unit 185 generates drive voltage, that is, Vry, Vrz, Vs, −V1, −V2, −Vy, Va, Vyb and Vzb illustrated in FIG. 6, that are supplied to the PDP 180. The drive voltage generation unit 185 includes a rising ramp waveform generation circuit 187 for generating first to fourth positive ramp waveforms PRY1, PRY2, PRY3 and PRY4, a falling ramp waveform generation circuit 189 for generating first and second falling ramp waveforms NRY1 and NRY2.

Figure 10:
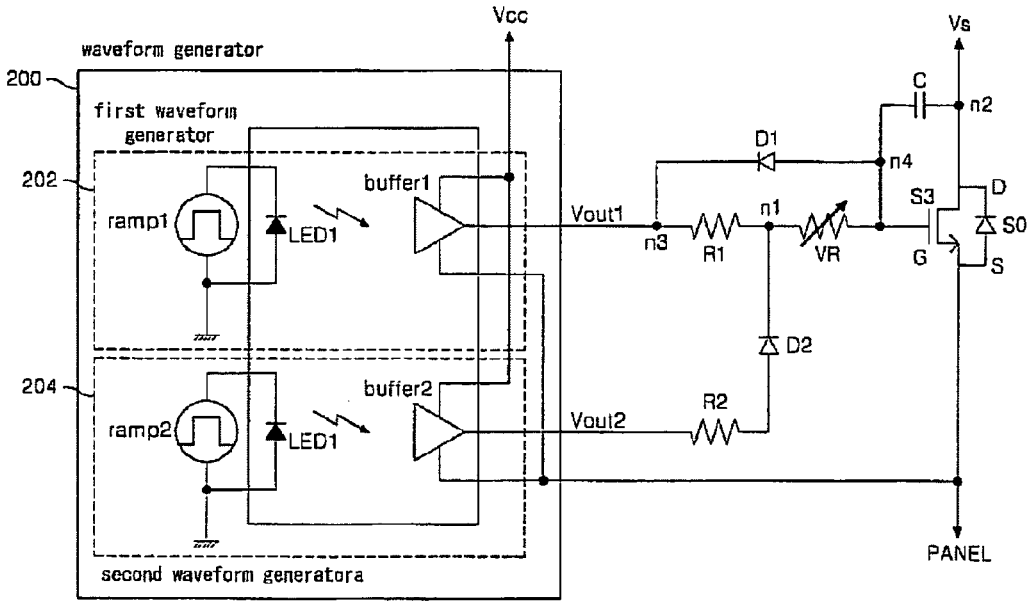
FIG. 10 is a diagram illustrating one rising ramp waveform generation circuit of the drive voltage generation unit of the plasma display device according to the present invention.

FIG. 10 is a diagram illustrating the rising ramp waveform generation circuit 187 of the drive voltage generation unit 185. The rising ramp waveform generation circuit 187 includes a switch element S0 connected between a sustain voltage source Vs and a panel, a first waveform generator 202 for generating the first output voltage Vout1 for generating a rising ramp waveform having a small slope, a second waveform generator 204 for generating a second output voltage Vout2 for generating a rising ramp waveform having a large slope through addition to the first output voltage Vout1, a first resistor R1 connected to the output terminal of the first waveform generator 202, a second resistor R2 connected to the output terminal of the second waveform generator 204, and a capacitor C connected to a first node n1 to which the first and second resistors R1 and R2 are connected and a second node n2 formed between the sustain voltage source Vs and the switch element S0.

The first and second waveform generators 202 and 204 are implemented using optical couplers. For this purpose, the first or second waveform generator 202 or 204 includes a first or second light emitting element LED1 or LED2 that receives a first or second input signal ramp1 or ramp2 and emits light, and a first or second light receiving element BUFFER that is electrically insulated from the first or second light emitting element LED1 or LED2, receives light from the first or second light emitting element LED1 or LED2 and generates the first or second output voltage. A variable resistor VR is connected between the first and second resistor R1 and R2 and the capacitor C and adjusts the slope of the ramp waveform by adjusting entire current gain.

Furthermore, the rising ramp waveform generation circuit 187 further includes a variable resistor VR connected between the first node n1 and the capacitor C, a first diode D1 connected between a third node n3 between the output terminal of the first waveform generator 202 and the first resistor R1 and a fourth node n4 between the capacitor C and the first node n1, an second diode D2 connected to the second output terminal and the first node n1.

The variable resistor VR adjusts the slope of the output ramp waveform by adjusting entire current gain. The first diode D1 emits a voltage induced to the switch element by noise, when the first and second output signal Vout1 and Vout2 are low. The second diode D2 prevents the first output signal from being applied to the second output terminal when the first output signal is high and the second output signal is low.

A process of generating setup waveforms having different slopes in the rising ramp waveform generation circuit 187 is described as follows. The first light emitting element LED1 receives the first input signal ramp1 and emits light so as to generate the first positive rising ramp waveform having a small slope. The first light receiving element BUFFER1, which is placed at a location electrically insulated from the first light emitting element LED1, receives a light signal emitted from the first light emitting element LED1 and generates the first output signal Vout1. The first output signal Vout1 generates a ramp waveform through a RC oscillation circuit composed of the first resistor and the capacitor C. The ramp waveform generated as described above is added to a sustain voltage value generated by the sustain voltage source Vs, thus generating the first positive rising ramp waveform PRY1.

In order to provide the third positive rising ramp waveform PRY3 having a slope larger than that of the first positive rising ramp waveform PRY1, the first and second input signals Vout1 and Vout2 are respectively applied to the first and second light emitting elements LED1 and LED2 at the same time. Light rays emitted from the first and second light emitting elements LED1 and LED2 are respectively applied to the first and second light receiving elements BUFFER1 and BUFFER2 in input signal form.

The first and second light receiving elements BUFFER1 and BUFFER2 respectively generate the first and second output signal Vout1 and Vout2. The output voltages Vout1 and Vout2 emitted from the first and second light emitting elements BUFFER1 and BUFFER2 respectively pass through the first resistor R1 and the second resistor R2 and are added to each other at the first node n1. The voltages added at the first node n1 generate the ramp waveform through the RC oscillation circuit.

Figure 11:
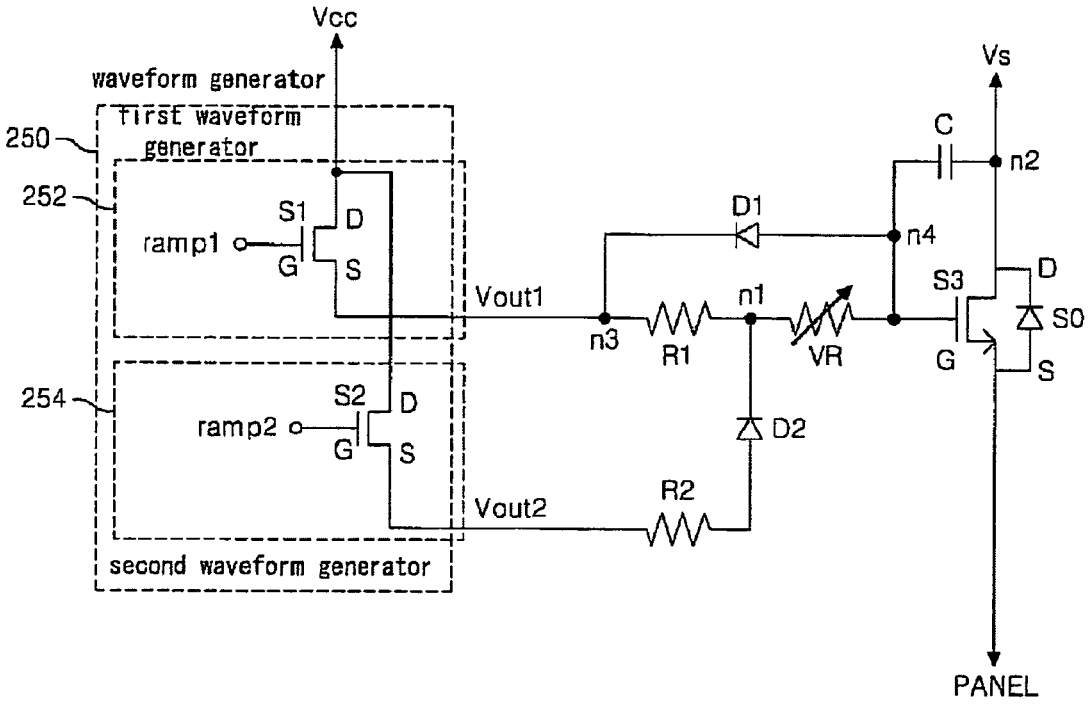
FIG. 11 is a diagram illustrating another rising ramp waveform generation circuit of the drive voltage generation unit of the plasma display device according to the present invention.

FIG. 11 is a diagram illustrating a rising ramp waveform generation circuit 187 according to another embodiment of the present invention. The rising ramp waveform generation circuit 187 includes a switch element S0 connected between a sustain voltage source Vs and a panel, a first waveform generator 252 for generating a first output voltage Vout1 for generating a rising ramp waveform having a small slope, a second waveform generator 254 for generating a second output voltage for generating a rising ramp waveform having a large slope through addition to the first output voltage Vout1, a first resistor R1 connected to the output terminal of the first waveform generator, a second resistor R2 connected to the output terminal of the second waveform generator 254, and a capacitor C connected to a first node n1 to which the first and second resistors R1 and R2 are connected and a second node n2 formed between the sustain voltage source Vs and the switch element S0.

The first and second waveform generator 252 and 254 are implemented using first and second MOSFETs S1 and S2. A variable resistor VR is connected between the first and second resistors R1 and R2 and the capacitor C, and adjusts the slope of the ramp waveform by adjusting entire current gain.

Furthermore, the rising ramp waveform generation circuit 187 further includes a variable resistor VR connected between the first node n1 and the capacitor C, a first diode D1 connected to a third node n3 between the output terminal of the first waveform generator 252 and the first resistor R1 and a fourth node n4 between the capacitor C and the first node n1, and a second diode D2 connected to a second output terminal and the first node n1.

The variable resistor VR adjusts the slope of the output ramp waveform by adjusting entire current gain. The first diode D1 emits a voltage induced to the switch element by noise, when the first and second output signal Vout1 and Vout2 are low. The second diode D2 prevents the first output signal from being applied to the second output terminal when the first output signal is high and the second output signal is low. A process for generating rising ramp waveforms having different slopes is omitted since one of ordinary skill can appreciate such operation based on the operation of the circuit of FIG. 10.

Figures are drawn for simplicity in explaining the invention. For example, FIG. 6 illustrates waveforms in an ideal situation, but as appreciated by one of ordinary skill in the art, voltage spikes during voltage transitions may be present in applications of such signals and/or waveforms. Further, the drawings have been illustrated to show pulses, but as appreciated by one of ordinary skill, these waveforms and/or signals may look different depending upon zooming or scale to illustrate such signals and/or waveforms.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A plasma display device comprising:

a Plasma Display Panel (PDP) having scan electrodes and sustain electrodes; and a first driving circuit for initializing discharge cells by applying rising waveforms and falling waveforms to the scan electrodes in a reset period;

a second driving unit for applying a positive polarity waveform to the sustain electrodes and a negative polarity waveform to the scan electrodes, in a pre-reset period prior to the reset period, wherein:

the first driving circuit is adapted to apply a rising waveform, which has a slope different from a slope of a rising waveform applied in a reset period of a first sub-field, in a reset period of a second sub-field disposed immediately after the first sub-field, the first subfield and the second subfield being included in a same frame, a part of the positive polarity waveform overlaps all of the negative polarity waveform, the rising waveform of the first sub-field has a first rising waveform of a first slope and a second rising waveform of a second slope, a voltage of the first rising waveform increasing in a substantially linear manner from a ground voltage to a first voltage and a voltage of the second rising waveform increasing in a substantially linear manner from the first voltage to a second voltage higher than the first voltage, the rising waveform of the second sub-field has a third rising waveform of a third slope and a fourth rising waveform of a fourth slope, a voltage of the third rising waveform increasing in a substantially linear manner from a ground voltage to a third voltage and a voltage of the fourth rising waveform increasing in a substantially linear manner from the third voltage to a fourth voltage higher than the third voltage, the third voltage is substantially equal to the first voltage, a time interval for the first rising waveform is applied is more than a time interval for the third rising waveform is applied, the first slope of the first rising waveform is greater than the second slope of the second rising waveform, and the third slope of the third rising waveform is greater than the fourth slope of the fourth rising waveform, and the third slope of the third rising waveform is greater than the first slope of the first rising waveform, and the fourth slope of the fourth rising waveform is greater than the second slope of the second rising waveform.

2. The plasma display device as set forth in claim 1, wherein the second rising waveform rises to a second voltage which is a highest voltage of the rising waveform of the first sub-field, and wherein the fourth rising waveform rises to the fourth voltage which is a highest voltage of the rising waveform of the second sub-field, wherein the fourth voltage is lower than the first voltage.

3. The plasma display device as set forth in claim 2, wherein the fourth voltage is lower than the second voltage by more than 10V and less than 100V.

4. The plasma display device as set forth in claim 1, wherein the fourth slope of the fourth rising waveform is equal to one to three times the second slope of the second rising waveform.

5. The plasma display device as set forth in claim 1, wherein the second drive unit applies the positive polarity waveform to the sustain electrodes and the negative polarity waveform to the scan electrodes, in at least a pre-reset period of the first sub-field in said same frame.

6. The plasma display device as set forth in claim 1, wherein the positive polarity waveform applied to the sustain electrodes is one of a rising waveform or a positive polarity square wave.

7. The plasma display device as set forth in claim 1, wherein the negative polarity waveform applied to the scan electrodes is one of a falling waveform or a positive polarity square wave.

8. The plasma display device as set forth in claim 7, wherein the falling negative polarity waveform has a slope substantially equal to a slope of a falling waveform applied in a set down period of the reset period.

9. The plasma display device as set forth in claim 1, wherein the positive polarity waveform has a voltage value larger than a voltage value of a positive polarity bias voltage applied to the sustain electrodes in an address period of at least one of the first sub-field or the second sub-field.

10. The plasma display device as set forth in claim 1, wherein the positive polarity waveform has a voltage value substantially equal to an amplitude of a voltage value of a negative polarity scan pulse applied to the scan electrodes in an address period of at least one of the first sub-field or the second sub-field.

11. The plasma display device as set forth in claim 1, further comprising a third drive unit for applying a reference potential or at least substantially 0V to the sustain electrodes in the reset period in at least one of the first sub-field or the second sub-field and a positive polarity bias voltage at a point in time when an address period successive to the reset period starts.

12. The plasma display device as set forth in claim 1, wherein a time interval for the second rising waveform is applied is more than a time interval for the fourth rising waveform is applied.

13. The plasma display device as set forth in claim 1, wherein a time interval between a start time point and a end time point of the reset period of the first subfield is more than a time interval between a start time point and a end time point of the reset period of the second subfield.

14. A method for driving a plasma display device during a plurality of sub-fields, the plasma display device having scan electrodes and sustain electrodes, the method comprising:

initializing discharge cells by applying rising waveforms and falling waveforms to the scan electrodes, said applying including:

applying a rising waveform, which has a slope different from a slope of a rising waveform applied in a reset period of a first sub-field, in a reset period of a second sub-field disposed right after the first sub-field, the first subfield and the second subfield being included in the same frame and applying a positive polarity waveform to the sustain electrodes and a negative polarity waveform to the scan electrodes, in a pre-reset period prior to the reset period of the first sub-field, wherein:

a part of the positive polarity waveform overlaps all of the negative polarity waveform, the rising waveform of the first sub-field has a first rising waveform of a first slope and a second rising waveform of a second slope, a voltage of the first rising waveform linearly increasing from a ground voltage to a first voltage and a voltage of the second rising waveform linearly increasing from the first voltage to a second voltage higher than the first voltage, the rising waveform of the second sub-field has a third rising waveform of a third slope and a fourth rising waveform of a fourth slope, a voltage of the third rising waveform linearly increasing from a ground voltage to a third voltage and a voltage of the fourth rising waveform linearly increasing from the third voltage to a fourth voltage higher than the third voltage, the third voltage is substantially equal to the first voltage, and a time interval for the first rising waveform is applied is more than a time interval for the third rising waveform is applied, the first slope of the first rising waveform is greater than the second slope of the second rising waveform, and the third slope of the third rising waveform is greater than the fourth slope of the fourth rising waveform, and the third slope of the third rising waveform is greater than the first slope of the first rising waveform, and the fourth slope of the fourth rising waveform is greater than the second slope of the second rising waveform.

15. A plasma display panel, comprising:

a plurality of scan electrodes and sustain electrodes in a first direction;

a plurality of address electrodes in a second direction substantially perpendicular to the first direction;

a plurality of cells, each cell being formed near an intersection of corresponding scan, sustain and address electrodes; and a driving circuit configured to drive at least one of the scan electrodes, sustain electrodes or address electrodes during a plurality of sub-fields, wherein:

each of first and second sub-fields includes a reset period, the reset period of one of the first or second sub-fields having a time period which is different from a time period of the reset period of the other of the first or second sub-fields, a number of sustain pulses supplied to at least one scan electrode and at least one sustain electrode during a sustain period of the second sub-field is greater than a number of sustain pulses supplied to the at least one scan electrode and the at least one sustain electrode during a sustain period of the first sub-field, rising waveforms are applied to a scan electrode during the reset periods of the first and second sub-fields respectively, the second sub-field is disposed right after the first sub-field, and the first sub-field and the second sub-field are included in a same frame, a slope of the rising waveform applied during the reset period of the first sub-field is different from a slope of the rising waveform applied during the rest period of the second sub-field, and a highest voltage of the rising waveform applied during the reset period of the first sub-field is higher than a highest voltage of the rising waveform applied during the reset period of the second sub-field, a positive polarity waveform is applied to the sustain electrodes and a negative polarity waveform is applied to the scan electrodes, in a pre-reset period prior to the reset period of the first sub-field, a part of the positive polarity waveform overlaps all of the negative polarity waveform, the rising waveform of the first sub-field has a first rising waveform of a first slope and a second rising waveform of a second slope, a voltage of the first rising waveform linearly increasing from a ground voltage to a first voltage and a voltage of the second rising waveform linearly increasing from the first voltage to a second voltage higher than the first voltage, the rising waveform of the second subfield has a third rising waveform of a third slope and fourth rising waveform of a fourth slope, a voltage of the third rising waveform linearly increasing from a ground voltage to a third voltage and a voltage of the fourth rising waveform linearly increasing from the third voltage to a fourth voltage higher than the third voltage, the third voltage is substantially equal to the first voltage, and a time interval for the first rising waveform is applied is more than a time interval for the third rising waveform is applied, the first slope of the first rising waveform is greater than the second slope of the second rising waveform, and the third slope of the third rising waveform is greater than the fourth slope of the fourth rising waveform, the third slope of the third rising waveform is greater than the first slope of the first rising waveform, and the fourth slope of the fourth rising waveform is greater than the second slope of the second rising waveform.

* * * * *